US009328868B2

(12) United States Patent
Dailly et al.

(10) Patent No.: US 9,328,868 B2
(45) Date of Patent: May 3, 2016

(54) METHOD OF INCREASING STORAGE CAPACITY OF NATURAL GAS TANK

(71) Applicant: GM GLOBAL TECHNOLOGY OPERATIONS LLC, Detroit, MI (US)

(72) Inventors: Anne M. Dailly, West Bloomfield, MI (US); Arianna T. Morales, Royal Oak, MI (US); Mahmoud H. Abd Elhamid, Troy, MI (US); Mei Cai, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 228 days.

(21) Appl. No.: 14/223,163

(22) Filed: Mar. 24, 2014

(65) Prior Publication Data

US 2014/0290789 A1 Oct. 2, 2014

Related U.S. Application Data

(60) Provisional application No. 61/806,170, filed on Mar. 28, 2013.

(51) Int. Cl.
*F17C 11/00* (2006.01)

(52) U.S. Cl.
CPC ..... *F17C 11/007* (2013.01); *F17C 2203/0639* (2013.01); *F17C 2203/0648* (2013.01); *F17C 2221/033* (2013.01)

(58) Field of Classification Search
CPC ..... F17C 11/00; F17C 11/007; F17C 2203/0639; F17C 2203/0648; F17C 2221/033
USPC ..... 141/1, 2, 4, 82, 94–95
See application file for complete search history.

(56) References Cited

U.S. PATENT DOCUMENTS 6,660,063 B2 * 12/2003 Tom ..... B01D 53/0407 206/0.7
7,418,782 B2 * 9/2008 Kimbara ..... C01B 3/0005 148/637
7,637,292 B2 * 12/2009 Handa ..... F17C 5/007 141/82
8,100,151 B2 * 1/2012 Handa ..... F17C 1/00 141/82
8,302,802 B2 * 11/2012 Handa ..... F17C 11/005 220/562
2003/0033930 A1 * 2/2003 Tom ..... B01D 53/0407 95/45
2008/0290645 A1 * 11/2008 Handa ..... F17C 1/00 280/834
2008/0296306 A1 * 12/2008 Handa ..... F17C 11/005 220/581
2008/0302110 A1 * 12/2008 Handa ..... F17C 5/007 62/50.1

OTHER PUBLICATIONS

Shipley, Eric: "Study of Natural Gas Vehicles (NGV) During the Fast Fill Process"; Master of Science in Mechanical Engineering; 2002; 145 pages.

* cited by examiner

*Primary Examiner* — Nicolas A Arnett
(74) *Attorney, Agent, or Firm* — Dierker & Kavanaugh, P.C.

(57) ABSTRACT

A method for increasing capacity of a natural gas (NG) tank. The method includes selecting a container with a service pressure rating of about 3,000 or 3,600 psi. An NG adsorbent is in the container. The container has a maximum fill capacity. The method further includes cooling the adsorbent by Joule-Thomson cooling during filling of the container with NG from a filling source at greater than 3,600 psi. The container is filled to the maximum fill capacity at a fill rate to prevent a bulk temperature of the adsorbent from rising more than about 5° C. above an ambient temperature. A rate of heat transfer from the tank is less than a rate of heating from compression of the NG and adsorption during the filling. The NG adsorbent adsorbs a higher amount of NG than it would at higher than 5° C. above ambient.

11 Claims, 4 Drawing Sheets

METHOD OF INCREASING STORAGE CAPACITY OF NATURAL GAS TANK

CROSS REFERENCE TO RELATED APPLICATION

This application claims the benefit of U.S. Provisional Patent Application Ser. No. 61/806,170 filed Mar. 28, 2013, which is incorporated by reference herein in its entirety.

BACKGROUND

Pressure vessels, such as, e.g., gas storage containers and hydraulic accumulators may be used to contain fluids under pressure. It may be desirable to have a pressure vessel with relatively thin walls and low weight. For example, in a vehicle fuel tank, relatively thin walls allow for more efficient use of available space, and relatively low weight allows for movement of the vehicle with greater energy efficiency.

SUMMARY

Examples of the present disclosure include a method for increasing the storage capacity of a natural gas tank. An example method includes selecting a container with a service pressure rating of about 3,600 psi to be filled with natural gas to a full tank pressure up to about 3,600 psi. A natural gas adsorbent is incorporated into the container. The container including the adsorbent therein has a maximum fill capacity. The example method further includes cooling the adsorbent by Joule-Thomson cooling during filling of the container with natural gas from a filling source at greater than 3,600 psi. The container is filled to the maximum fill capacity at a fill rate to prevent a bulk temperature of the adsorbent from rising more than about 5° C. above an ambient temperature. A rate of heat transfer from the tank is less than a rate of heating from compression of the natural gas and adsorption during the filling. The natural gas adsorbent adsorbs a higher amount of natural gas than would the adsorbent at temperatures higher than 5° C. above the ambient temperature.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
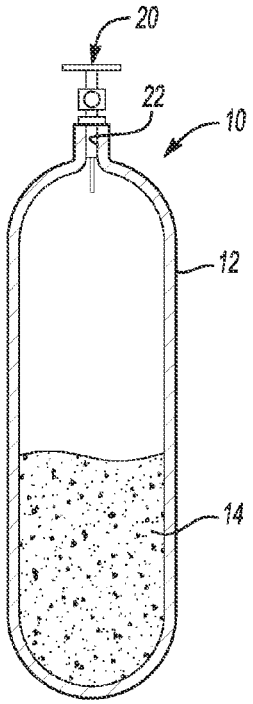
FIG. 1 is a cross-sectional, semi-schematic view of an example of a high pressure natural gas tank according to the present disclosure.

Natural gas automotive vehicles are fitted with on-board storage tanks Adsorbent natural gas (ANG) storage tanks are generally designed as low pressure systems. In an example of such a low pressure system, at about 725 psi (about 50 bar), a vehicle including a 0.1 $m^3$ (i.e., 100 L) natural gas tank filled with a suitable amount of a carbon adsorbent having a BET surface area of about 1000 $m^2/g$, a bulk density of 0.5 $g/cm^3$, and a total adsorption of 0.13 g/g is expected to have about 2.85 GGE (Gallon of Gasoline Equivalent) (for a range of about 85 miles), assuming 30 mpg.

However, examples herein disclose ANG high pressure systems. These high pressure systems may have service pressure ratings ranging from about 200 bar (about 2,901 psi) to about 300 bar (about 4,351 psi); or from about 20,684 kPa (~207 bar/3,000 psi) to about 24,821 kPa (~248 bar/3,600 psi). During fueling, the container of the high pressure system storage tank is designed to fill until the tank achieves a pressure within the designated service rated range.

In the examples disclosed herein, the container of the tank is rated for the high pressures, and the adsorbent in the ANG tank, when the tank is filled according to examples of the present method, increases the storage capacity so that the tank is capable of storing and delivering a sufficient amount of natural gas for desired vehicle operation.

However, prior to realizing the advantages of the examples of the method disclosed herein, it would have been expected that including adsorbent in a natural gas tank for high pressure applications would have been a disadvantage. For example, including into a 0.1 $m^3$ (i.e., 100 L) natural gas tank, a carbon adsorbent having a BET surface area of about 1000 $m^2/g$, a bulk density of 0.5 $g/cm^3$, and filling (without utilizing examples of the present method) at about 3,600 psi (about 248 bar) may generally result in a total adsorption of about 0.3 g/g, with an expectation of about 6.6 GGE (for a range of about 197 miles), assuming 30 mpg. For comparison, a 100 L compressed natural gas (CNG) tank without adsorbent filled at 250 bar would have about 8.3 GGE (for a range of about 250 miles), assuming 30 mpg. As such, without using the methods of the present disclosure, the tank with adsorbent would be expected to have about 1.7 GGE less than the same 100 L tank with no adsorbent.

In contrast, examples of the present method may advantageously be used to fill ANG tanks at high pressure fueling stations (e.g., retail or fleet refueling stations), without deleterious loss of tank storage capacity.

Further, in some examples of the present method, depending on the adsorbent selected, it is contemplated as being within the purview of the present disclosure to obtain better performance/higher storage capacity with the adsorbent at 250 bar than would a CNG tank (having no adsorbent) at 250 bar.

It is believed that the adsorption effect of the quantity of adsorbent in the examples disclosed herein is high enough to compensate for any loss in storage capacity due to the skeleton of the adsorbent occupying volume in the container. For the same temperature and pressure, the density of the adsorbed phase is bigger than the density of the gas phase. As such, the adsorbent will maintain or improve the container's storage capacity of compressed natural gas at high pressures.

Increased storage capacity generally leads to obtaining higher vehicle mileage. It is believed that the examples disclosed herein will exhibit higher, or on par natural gas storage capacity and thus higher, or on par vehicle mileage when compared to benchmark compressed gas technology.

Referring now to FIG. 1, an example of the natural gas tank 10 is depicted. The tank 10 generally includes a container 12 and a natural gas adsorbent 14 operatively disposed within the container 12.

The container 12 may be made of any material that is suitable for a reusable pressure vessel having a service rating up to about 3,600 psi. Examples of suitable container 12 materials include high strength aluminum alloys and high strength low alloy (HSLA) steels. Examples of high strength aluminum alloys include those in the 7000 series, which have relatively high yield strength. The 7000 series is a naming convention for wrought alloys, from the International Alloy Designation System. 7000 series aluminum alloys are alloyed with zinc, and can be precipitation hardened to the highest strengths of any aluminum alloy. One specific example includes aluminum 7075-T6 which has a tensile yield strength of about 73,000 psi. Examples of high strength low alloy steel generally have a carbon content ranging from about 0.05% to about 0.25%, and the remainder of the chemical composition varies in order to obtain the desired mechanical properties. Examples of HSLA steel are: ASTM International A572-50 (yield strength=50,000 psi); A516-70 (yield strength=38,000 psi); and A588 (yield strength=50,000 psi).

While the shape of the container 12 shown in FIG. 1 is a cylindrical canister, it is to be understood that the shape and size of the container 12 may vary depending, at least in part, on an available packaging envelope for the tank 10 in the vehicle. For example, the size and shape may be changed in order to fit into a particular area of a vehicle trunk.

In the example shown in FIG. 1, the container 12 is a single unit having a single opening 22 or entrance. The opening 22 may be operatively fitted with a valve member 20, for charging the container 12 with the gas or for drawing-off the gas from the container 12. It is to be understood that manual and/or solenoid activated tank valves may be used in examples of the present disclosure. The valve member 20 is operatively connected to, and in fluid communication with the container 12 via the opening 22 defined in a wall of the container 12, the container wall having a thickness ranging, e.g., from about 3 mm to about 10 mm. It is to be understood that the opening 22 may be threaded for a typical tank valve (e.g., ¾×14 NGT (National Gas Taper Thread)). Further, it is to be understood that opening 22 may be located at any area of the container wall and is not necessarily located at the end as shown in FIG. 1.

While not shown, it is to be understood that the container 12 may be configured with other containers so that the multiple containers are in fluid (e.g., gas) communication through a manifold or other suitable mechanism.

As illustrated in FIG. 1, the natural gas adsorbent 14 is positioned within the container 12. Suitable adsorbents 14 are at least capable of releasably retaining methane compounds (i.e., reversibly storing or adsorbing methane molecules). In some examples, the selected adsorbent 14 may also be capable of reversibly storing other components found in natural gas, such as other hydrocarbons (e.g., ethane, propane, hexane, etc.), hydrogen gas, carbon monoxide, carbon dioxide, nitrogen gas, and/or hydrogen sulfide. In still other examples, the selected adsorbent 14 may be inert to some of the natural gas components and capable of releasably retaining other of the natural gas components.

In general, the adsorbent 14 has a high surface area and is porous. The size of the pores is generally greater than the effective molecular diameter of at least the methane compounds in the natural gas. In an example, the pore size distribution is such that there are pores having an effective molecular diameter of the smallest compounds to be adsorbed and pores having an effective molecular diameter of the largest compounds to be adsorbed. In an example, the adsorbent 14 has a Brunauer-Emmett-Teller (BET) surface area greater than about 50 square meters per gram ($m^2/g$) and up to about 2,000 $m^2/g$, and includes a plurality of pores having a pore size from about 0.20 nm (nanometers) to about 50 nm.

Examples of suitable adsorbents 14 include carbon (e.g., activated carbons, super-activated carbon, carbon nanotubes, carbon nanofibers, carbon molecular sieves, zeolite templated carbons, etc.), zeolites, metal-organic framework (MOF) materials, porous polymer networks (e.g., PAF-1 or PPN-4), and combinations thereof. Examples of suitable zeolites include zeolite X, zeolite Y, zeolite LSX, MCM-41 zeolites, silicoaluminophosphates (SAPOs), and combinations thereof. Examples of suitable metal-organic frameworks include HKUST-1, MOF-74, ZIF-8, and/or the like, which are constructed by linking tetrahedral clusters with organic linkers (e.g., carboxylate linkers).

The volume that the adsorbent 14 occupies in the container 12 will depend upon the density of the adsorbent 14. In an example, the density of the adsorbent 14 may range from about 0.1 g/cc to about 0.9 g/cc. A well-packed adsorbent 14 may have a density of about 0.5 g/cc. In an example, a 100 L container may include an amount of adsorbent that occupies about 50 L. For example, an amount of adsorbent that occupies about 50 L means that the adsorbent would fill a 50L container. It is to be understood, however, that there is space available between the particles of adsorbent, and having an adsorbent that occupies 50 L in a 100 L container does not reduce the capacity of the container for natural gas by 50 L.

The tank 10 may also include a guard bed (not shown) positioned at or near the opening 22 of the container 12 so that introduced natural gas passes through the guard bed before reaching the adsorbent 14. In examples, the guard bed may be to filter out certain components (e.g. contaminants) so that only predetermined components (e.g., methane and other components that are reversibly adsorbed on the adsorbent 14) reach the adsorbent 14. It is contemplated that any adsorbent that will retain the contaminants may be used as the guard bed. For example, the guard bed may include an adsorbent material that will remove higher hydrocarbons (i.e. hydrocarbons with more than 4 carbon atoms per molecule) and catalytic contaminants, such as hydrogen sulfide and water. In an example, the guard bed may include adsorbent material that retains one or more of the contaminants while allowing clean natural gas to pass therethrough. By retaining the contaminants, the guard bed protects the adsorbent 14 from exposure to the contaminants. The level of protection provided by the guard be depends on the effectiveness of the guard bed in retaining the contaminants. The pore size of the adsorbent in the guard bed may be tuned/formulated for certain types of contaminants so that the guard bed is a selective adsorbent.

In some instances, the adsorbent 14 may be regenerated, so that any adsorbed components are released, and the adsorbent 14 is cleaned. In an example, regeneration of adsorbent 14 may be accomplished either thermally or with inert gases. For one example, hydrogen sulfide may be burned off when the adsorbent is treated with air at 350° C. In another example, contaminants may be removed when the adsorbent is flushed with argon gas or helium gas. After a regeneration process, it is believed that the original adsorption capacity of adsorbent 14 is substantially, if not completely, recovered.

In an example of the method of making the natural gas storage tank, the container 12 may be formed and then the adsorbent 14 may be operatively disposed in the container 12. In another example of the method, the adsorbent 14 may be introduced during the manufacturing of the container 12.

Figure 2:
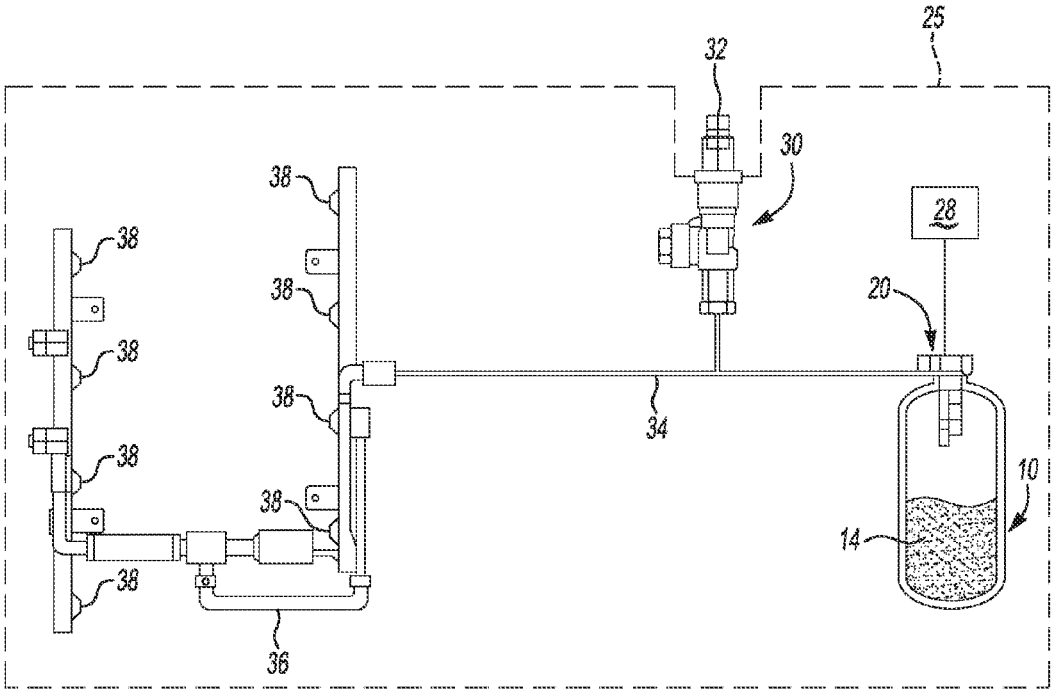
FIG. 2 is a semi-schematic view of an example of a natural gas fuel system in a vehicle.

Referring now to FIG. 2, an example of a natural gas fuel supply system is depicted in a vehicle schematically shown at 25. In this example system, an ANG tank 10 is operatively connected to, and in fluid communication with a fuel line 34. Fuel line 34 is connected to orifice 30 and fuel fill valve 32, and valve member 20. The valve member 20 may be controlled by electronic control unit 28 mounted on the vehicle 25. Fuel line 34 is also operatively connected to, and in fluid communication with fuel injector supply manifold/fuel rail 36. Manifold/rail 36 is in operative and fluid communication with one or more fuel injector ports 38.

Figure 3:
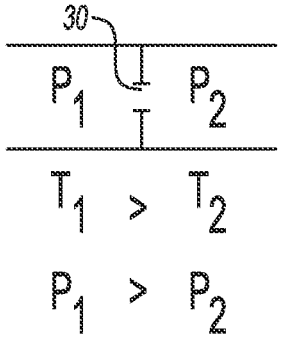
FIG. 3 is an example diagram illustrating pressure flow and temperature change at an orifice.

Referring now to FIG. 3, an example diagram illustrates Joule-Thomson throttling though an orifice 30. The orifice is substantially insulated, and no work is done by the expanding gas, so flow through the orifice 30 is adiabatic. Adiabatic means the flow is isenthalpic. It is understood that the orifice may not be perfectly insulated and that natural gas is a real gas rather than an ideal gas. Therefore the flow may not be completely or absolutely adiabatic. As used herein, adiabatic means perfectly adiabatic, or substantially adiabatic where the change in enthalpy is less than 5 percent, resulting in Joule-Thomson cooling. As natural gas is filled into a relatively empty container 12 via orifice 30, the pressure $P_1$ (the supply pressure, e.g., about 3,600 psi) is greater than the initially low in-container pressure $P_2$. At initial filling, the temperature $T_1$ on the supply side of the orifice 30 is greater than the temperature $T_2$ on the tank side of the orifice 30. Examples of the present disclosure may use Joule-Thomson cooling to enhance storage capacity of the adsorbent 14.

Figure 4:
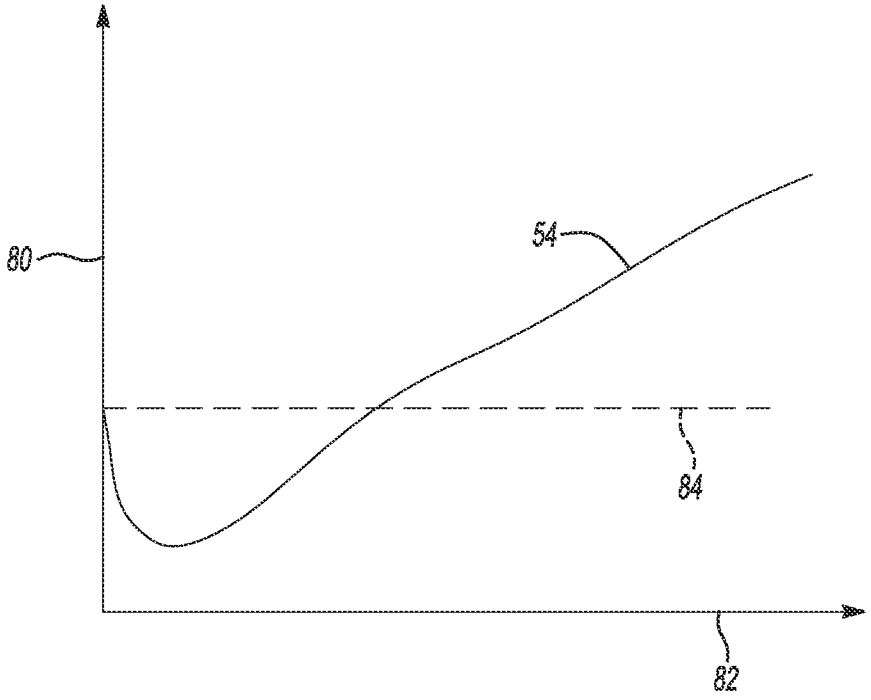
FIG. 4 is a graph illustrating temperature versus natural gas fill time.

FIG. 4 is a graph illustrating natural gas temperature versus time for a fast fill event. Temperature is depicted on the axis having reference numeral 80, and time is depicted on the axis having reference numeral 82. Ambient temperature is depicted by the dashed horizontal line at reference numeral 84. The temperature of the natural gas in the container is depicted by the trace indicated at reference numeral 54. During filling of a natural gas vehicle (NGV) container 12, the in-container temperature is seen to rise. However, under certain conditions, the container 12 gas temperature is shown to dip significantly in early filling time for an empty container before rising to a final value as shown in FIG. 4. The reason, at least in part, for the dip in temperature in the early part of the filling of a nearly empty container 12 may be a result of the Joule-Thomson cooling effect, which the gas undergoes in the isenthalpic expansion through the filling orifice 30, from the filling station at about 3,600 psi supply pressure to the initially low in-container pressure.

Figure 5:
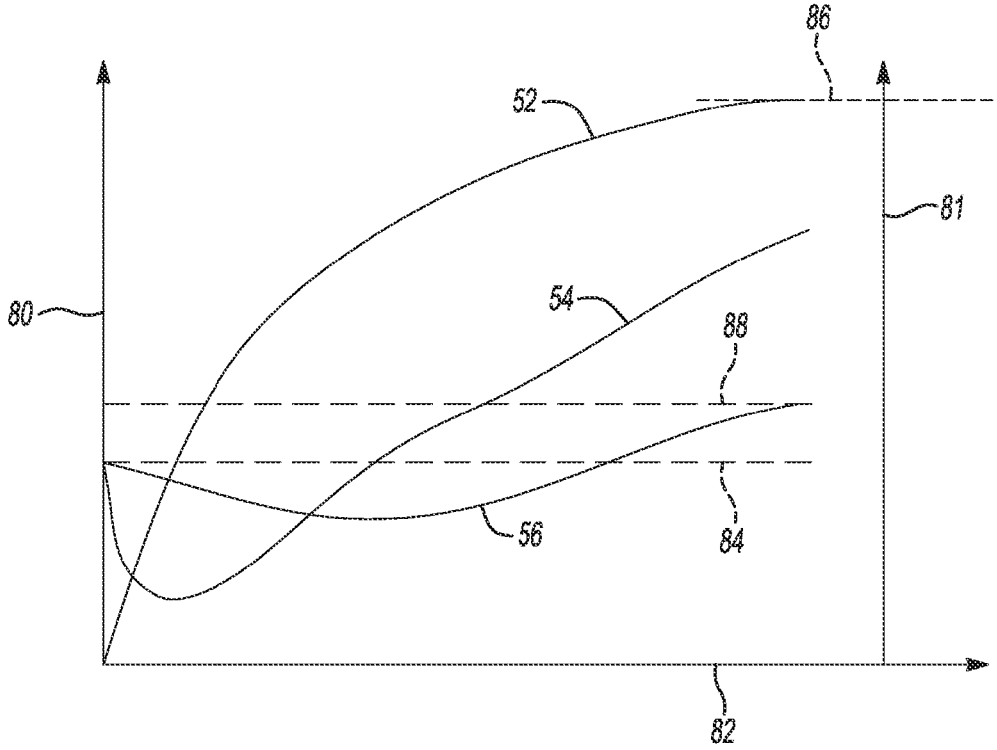
FIG. 5 is graph depicting filling a tank with natural gas and cooling the adsorbent by Joule-Thomson cooling according to the method of present disclosure.

FIG. 5 is a combined graph showing time, temperature, and mass of an example of the method of the present disclosure. Temperature is depicted on the axis having reference numeral 80, and time is depicted on the axis having reference numeral 82. Mass is depicted on the axis having reference numeral 81. Ambient temperature is depicted by the dashed horizontal line at reference numeral 84, and the dashed horizontal line at reference numeral 88 depicts 5° C. above the ambient. FIG. 5 depicts an estimate of natural gas mass loaded in the container 12 at 52, a temperature of the natural gas in the container at 54, and an adsorbent bulk temperature 56. The curves show the bulk temperature 54 cooling until the adsorbent bulk temperature 56 curve crosses the rising natural gas temperature 54. After the natural gas temperature 54 is above the adsorbent bulk temperature 56, the adsorbent bulk temperature begins to rise. However, the fill rate is fast enough that the maximum fill capacity 86 is reached before the adsorbent bulk temperature 56 can exceed 5° C. above ambient. The fill rate is an amount of natural gas transferred into the container 54 in an interval of time. The fill rate is a function of a pressure difference across the filling orifice 30, and other factors. The overall fill rate means the maximum fill capacity divided by a total time to fill the container to the maximum fill capacity. The natural gas adsorbent adsorbs a higher amount of natural gas than would the adsorbent at temperatures higher than 5° C. above the ambient temperature. As such, by following the example of the present disclosure, the maximum fill capacity stores a larger mass of natural gas in the container compared to the mass stored in a container in which the natural gas adsorbent rises more than 5° C. above the ambient.

Figure 6:
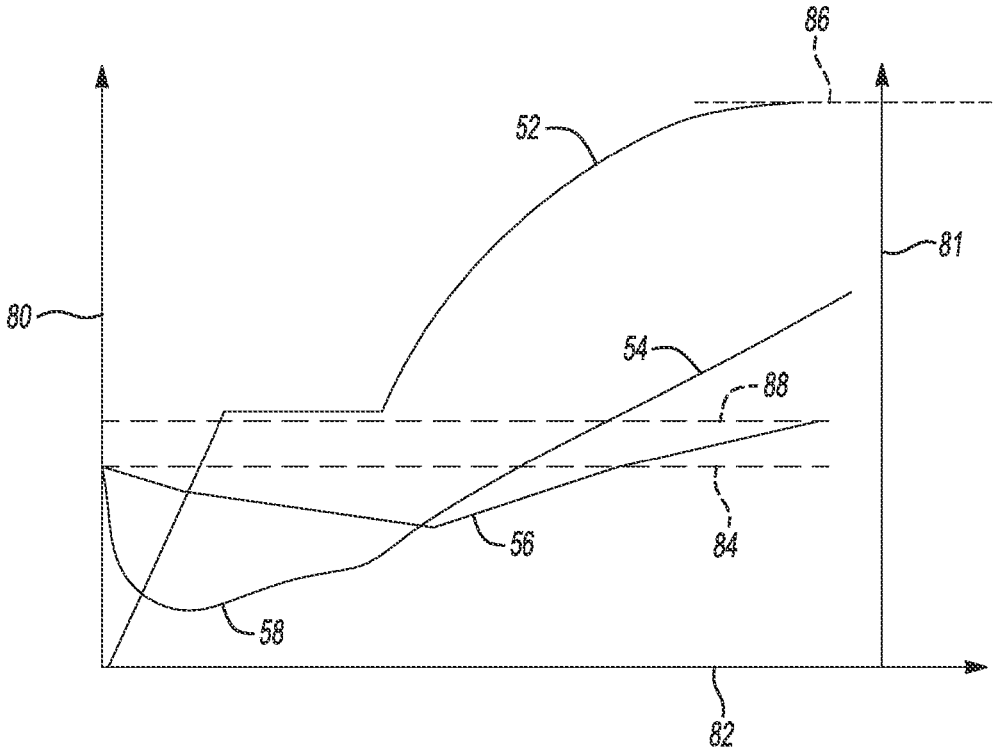
FIG. 6 is another graph depicting suspending natural gas transfer to cool adsorbent by Joule-Thomson cooling followed by rapidly filling the tank according to the present disclosure.

FIG. 6 is a combined graph showing time, temperature, and mass of another example of the method of the present disclosure. Temperature is depicted on the axis having reference numeral 80, and time is depicted on the axis having reference numeral 82. Mass is depicted on the axis having reference numeral 81. Ambient temperature is depicted by the dashed horizontal line at reference numeral 84, and the dashed horizontal line at reference numeral 88 depicts 5° C. above the ambient. FIG. 6 depicts an estimate of natural gas mass loaded in the container 12 at 52, a temperature of the natural gas in the container at 54, and an adsorbent bulk temperature 56. Similarly to FIG. 5, the curves show the adsorbent bulk temperature 56 cooling until the adsorbent bulk temperature 56 curve crosses the rising natural gas temperature 54.

However, FIG. 6 is different from FIG. 5 in that the flow of the natural gas at a first fill rate range is temporarily suspended at about the same time as the nadir 58 of the natural gas temperature 54. Stopping the gas flow allows the natural gas that was cooled by the Joule-Thomson effect to continue to cool the adsorbent 14. The natural gas warms from receiving heat from the adsorbent 14. After a period of time, a difference between the natural gas temperature 54 and the adsorbent bulk temperature 56 becomes relatively small and the benefit of further delaying resumption of refueling is diminished. After the adsorbent 14 has been cooled, refueling is resumed at a second fill rate range to reach the maximum fill capacity 86 before the adsorbent reaches a temperature more than 5° C. above the ambient temperature. After the natural gas temperature 54 is above the adsorbent bulk temperature 56, the adsorbent bulk temperature begins to rise. However, the fill rate is fast enough that the maximum fill capacity 86 is reached before the adsorbent bulk temperature 56 exceeds 5° C. above ambient. The natural gas adsorbent 14 adsorbs a greater mass of natural gas than would the adsorbent at temperatures higher than 5° C. above the ambient temperature. As such, by following the example of the present disclosure, the maximum fill capacity stores a larger mass of natural gas in the container compared to the mass stored in a container in which the natural gas adsorbent rises more than 5° C. above the ambient.

Figure 7:
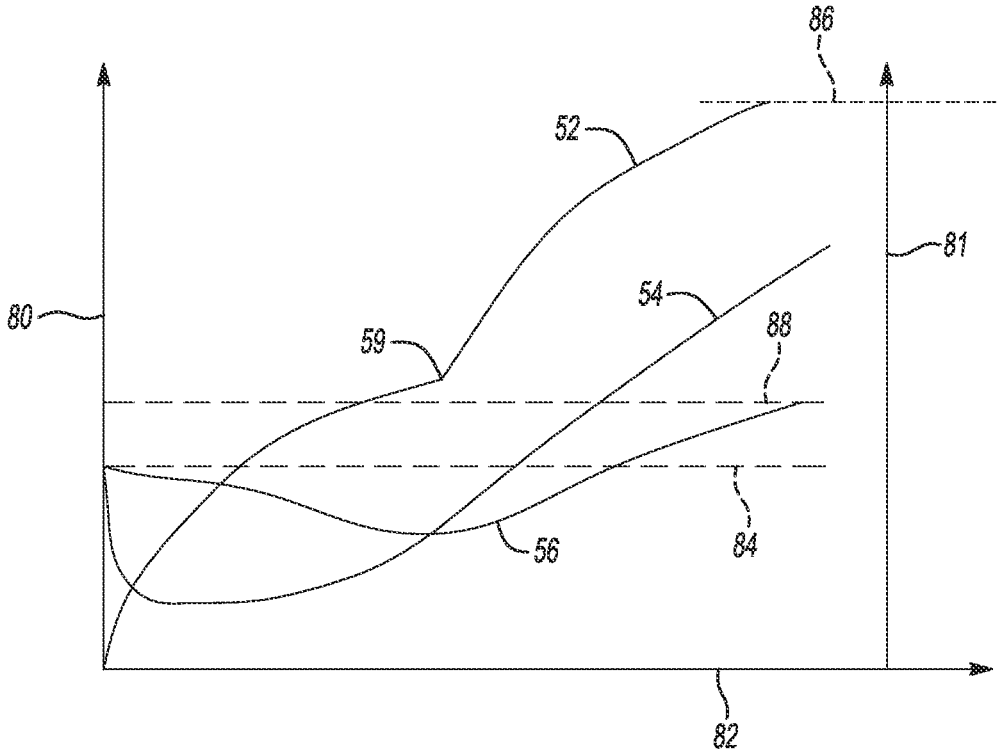
FIG. 7 is yet another graph depicting transferring the natural gas in two fill stages to cool the adsorbent by Joule-Thomson cooling according to the present disclosure.

FIG. 7 is a combined graph showing time, temperature, and mass of another example of the method of the present disclosure. Temperature is depicted on the axis having reference numeral 80, and time is depicted on the axis having reference numeral 82. Mass is depicted on the axis having reference numeral 81. Ambient temperature is depicted by the dashed horizontal line at reference numeral 84, and the dashed horizontal line at reference numeral 88 depicts 5° C. above the ambient. FIG. 7 depicts an estimate of natural gas mass loaded in the container 12 at 52, a temperature of the natural gas in the container at 54, and an adsorbent bulk temperature 56. Similarly to FIG. 6, the curves show the adsorbent bulk temperature 56 cooling until the adsorbent bulk temperature 56 curve crosses the rising natural gas temperature 54.

However, FIG. 7 is different from FIGS. 5 and 6 in that the flow of the natural gas at a first fill rate range is continued relatively slowly to cool the adsorbent 14 by a predetermined temperature depression 62 before the Joule-Thomson effect ceases across the effective orifice. The natural gas that was cooled by the Joule-Thomson effect continues to cool the adsorbent 14 until the natural gas temperature 54 crosses the adsorbent bulk temperature 56. After the adsorbent 14 has been cooled, refueling is continued at a second fill rate range (depicted beginning at 59) to reach the maximum fill capacity 86 before the adsorbent reaches a temperature more than 5° C. above the ambient temperature. After the natural gas temperature 54 is above the adsorbent bulk temperature 56, the adsorbent bulk temperature begins to rise. However, the second fill rate is fast enough that the maximum fill capacity 86 is reached before the adsorbent bulk temperature 56 exceeds 5° C. above ambient. The natural gas adsorbent 14 adsorbs a greater mass of natural gas than would the adsorbent at temperatures higher than 5° C. above the ambient temperature. As such, by following the example of the present disclosure, the maximum fill capacity stores a larger mass of natural gas in the container compared to the mass stored in a container in which the natural gas adsorbent rises more than 5° C. above the ambient.

In the description of FIGS. 5, 6, and 7, the term "fill rate range" is used to recognize that the accumulation of mass of natural gas in the container is non-linear. As such, the rate (time derivative) is not constant, but changes continuously as the pressure difference across the effective orifice changes. It is to be understood that the fill rate range may be controlled by changing the effective orifice. As such, a larger orifice will result in higher fill rates for a particular set of natural gas pressures and temperatures.

Examples of the present disclosure may be implemented by using a refueling station to control a rate of flow of the natural gas into the container 12. Other examples may be implemented by using an electronic control unit 28 mounted on the vehicle to control valve mounted on the vehicle that, in turn, controls a rate of flow of the natural gas into the container 12. Still other examples may be implemented using temperature sensitive materials to control the vehicle mounted valve.

The present inventors have unexpectedly and fortuitously discovered that selectively utilizing/manipulating a similar effect on a container 12 containing an adsorbent 14 may lead to higher gas uptake. Adsorption-based natural gas (ANG) technology relies on physisorption. Adsorption becomes more significant when the temperature decreases. During the early part of the filling event, the in-container gas temperature can drop by over 10K which results in higher gas uptake from the adsorbent than what would be observed without a temperature change. The in-container gas temperature will then increase when the compression and conversion of supply enthalpy energy to container internal energy overcomes the Joule Thomson cooling effect, which becomes smaller as the container pressure increases. Although the gas in the tank may experience a temperature increase, the temperature of the adsorbent may take time to reach an equilibrium temperature with the gas. Since the adsorption capacity of the adsorbent is greater at cooler temperatures, the adsorbent adsorbs more natural gas during refueling. As the temperature of the adsorbent warms to equilibrium with the gas in the tank, some of the adsorbed gas is released. However, in examples of the present disclosure, it takes more time to warm the adsorbent than it takes to refuel. Therefore, the total mass of natural gas loaded into the tank is increased.

It is to be understood that examples of the present disclosure are distinct from systems and methods that use slow fill techniques. Slow fill may take hours for the temperature to equilibrate to fill a tank to capacity. Fast fill generally takes no longer to load natural gas in a vehicle than it would take to pump gasoline in a similar vehicle. In sharp contrast to examples of the present disclosure, conventional, uncompensated refueling stations filling conventional natural gas fuel tanks generally load more fuel in the tank with slow fill than fast fill. One reason that slow fill can add more fuel into a conventional fuel tank than fast fill is that the heat of compression of the gas in the tank is dissipated to the environment as quickly as the heat is generated. Another method of slow fill is to dissipate the heat of compression from the tank and "top off" the tank with diminishingly smaller amounts of natural gas when the tank temperature is at ambient.

Unlike examples of the present disclosure, some fuel fill methods use a fill rate that is slow enough that the adsorbent temperature rises as high as 10 degrees C. over ambient. As such, the adsorbent adsorbs less natural gas than the cooler adsorbent of examples of the present disclosure. In examples of the present disclosure, the fill rate may be increased by increasing the flow capacity of the tubing and valves between the refueling source and the container 12.

Advantages of examples of the present disclosure include higher storage capacity in tank 10, that could result in higher mileage when used as an on board storage and fuel delivery system.

It is to be understood that the ranges provided herein include the stated range and any value or sub-range within the stated range. For example, a range from about 0.1 g/cc to about 0.9 g/cc should be interpreted to include not only the explicitly recited limits of about 0.1 g/cc to about 0.9 g/cc, but also to include individual values, such as 0.25 g/cc, 0.49 g/cc, 0.8 g/cc, etc., and sub-ranges, such as from about 0.3 g/cc to about 0.7 g/cc; from about 0.4 g/cc to about 0.6 g/cc, etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

Furthermore, reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it will be apparent to those skilled in the art that the disclosed examples may be modified. Therefore, the foregoing description is to be considered non-limiting.

What is claimed is:

1. A method for increasing a storage capacity of a natural gas tank, the method comprising:

selecting a container with a service pressure rating of about 3,000 psi or 3,600 psi to be filled with natural gas to a full tank pressure up to about 3,000 psi or 3,600 psi respectively wherein the container has a natural gas adsorbent disposed therein and the container having the adsorbent has a maximum fill capacity;

cooling the adsorbent by Joule-Thomson cooling during filling of the container with natural gas from a filling source at greater than 3,000 psi or 3,600 psi; and filling the container to the maximum fill capacity at an overall fill rate to prevent a bulk temperature of the adsorbent from rising more than about 5° C. above an ambient temperature;

wherein a rate of heat transfer from the tank is less than a rate of heating from compression of the natural gas and adsorption during the filling;

wherein the natural gas adsorbent adsorbs a higher amount of natural gas than would the adsorbent at temperatures higher than 5° C. above the ambient temperature;

and wherein the overall fill rate is the maximum fill capacity divided by a total time to fill the container to the maximum fill capacity.

2. The method as defined in claim 1 wherein cooling the adsorbent by Joule-Thomson cooling includes adiabatically transferring a quantity of the natural gas at a first fill rate range through an effective orifice in fluid connection with the container, suspending a refueling after the natural gas has been cooled to allow a quantity of the natural gas cooled by the Joule-Thomson cooling to cool the adsorbent followed by resuming the refueling at a second fill rate range to reach the maximum fill capacity before the adsorbent reaches a temperature more than 5° C. above the ambient temperature.

3. The method as defined in claim 1 wherein cooling the adsorbent by Joule-Thomson cooling includes adiabatically transferring a quantity of the natural gas at a first fill rate range through an effective orifice in fluid connection with the container wherein the first fill rate range causes the adsorbent to cool by a predetermined temperature depression before a Joule-Thomson effect ceases across the effective orifice followed by continuing the refueling at a second fill rate range to reach the maximum fill capacity before the adsorbent reaches a temperature more than 5° C. above the ambient temperature.

4. The method as defined in claim 1 wherein a valve mounted on a vehicle controls a rate of flow of the natural gas into the container, and an electronic control unit mounted on the vehicle controls the valve.

5. The method as defined in claim 1 wherein the natural gas adsorbent is a high surface area material having a high porosity.

6. The method as defined in claim 5 wherein the natural gas adsorbent is selected from the groups consisting of a carbon, a porous polymer network, a metal-organic framework, a zeolite, and combinations thereof.

7. The method as defined in claim 5 wherein the natural gas adsorbent is inert to at least some components in natural gas other than methane.

8. The method as defined in claim 1 wherein the natural gas adsorbent has a density ranging from about 0.1 g/cc to about 0.9 g/cc.

9. The method as defined in claim 1 wherein the container is made of a high strength aluminum alloy or a high strength low alloy (HSLA) steel.

10. The method as defined in claim 9 wherein the high strength aluminum alloy is a 7000 series aluminum alloy in the International Alloy Designation System.

11. The method as defined in claim 9 wherein the HSLA steel includes ASTM International A572-50, A516-70, or A588.

* * * * *